United States Patent [19]

Newmar

[11] 4,003,094

[45] * Jan. 18, 1977

[54] PANTYHOSE WITH SHAPING BAND FOR CHEEKY DERRIER RELIEF

[76] Inventor: Julie Newmar, 12 Beekman Place, New York, N.Y. 10022

[ * ] Notice: The portion of the term of this patent subsequent to Oct. 28, 1992, has been disclaimed.

[22] Filed: Aug. 28, 1975

[21] Appl. No.: 608,549

Related U.S. Application Data

[63] Continuation-in-part of Ser. No. 509,080, Sept. 25, 1974, Pat. No. 3,914,799.

[52] U.S. Cl. ..... 2/409

[51] Int. Cl.[2] ..... A41B 9/04

[58] Field of Search ..... 2/224 R, 224 A, 225, 2/226, 227, 240, 406, 407, 409; 128/528; 66/177, 178 R

[56] References Cited

UNITED STATES PATENTS 2,522,510 9/1950 Fridolph ..... 128/528

FOREIGN PATENTS OR APPLICATIONS 6,918,644 6/1971 Netherlands ..... 2/224 R 1,230,158 4/1971 United Kingdom ..... 2/224 R

*Primary Examiner*—H. Hampton Hunter

*Attorney, Agent, or Firm*—Charles E. Baxley

[57] ABSTRACT

This disclosure teaches pantyhose wherein a panty portion is made of a resilient stretchable fabric (such as one made of a blend of nylon elastomeric fibers) enclosing a wearer's lower torso and is provided with a conventional elastic waist encircling band. The panty portion includes a rear panty portion which covers and confines the wearer's buttocks. The pantyhose also define a crotch zone between leg portions. An elastic shaping band is attached to the rear panty portion and is connected from the vicinity of the crotch zone to the vicinity of the waist band and fits between the wearer's buttocks to delineate the wearer's derriere in cheeky relief.

6 Claims, 4 Drawing Figures

PANTYHOSE WITH SHAPING BAND FOR CHEEKY DERRIER RELIEF

CROSS REFERENCE

This is a continuation-in-part application with respect to my copending U.S. patent application Ser. No. 509,080 filed Sept. 25, 1974, now U.S. Pat. No. 3,914,799 which issued on Oct. 28, 1975.

BACKGROUND OF INVENTION

When resilient stretchable fabrics (such as Monsanto's MONVELLE, a biconstituted fabric of 50% nylon and 50% elastomeric fibers) are used for pantyhose, they provide support for a wearer's legs as well as confinement for the wearer's lower abdomen and derriere. Usually the more flattening of the wearer's lower abdomen (tummy) that is achieved, the more tendency there is to flatten and denaturalize the wearer's derriere (nickname deleted).

STATEMENT OF INVENTION

The present invention provides pantyhose of a resilient stretchable fabric which enhance natural shape of a wearer's derriere giving it cheeky relief, rather than boardlike flatness. The pantyhose include a rear panty portion which covers and confines the wearer's buttocks. An elastic shaping band is attached to the rear panty portion and is connected from the vicinity of the wearer's crotch zone rearward to the vicinity of a waist band of the pantyhose. The elastic shaping band fits between the wearer's buttocks to produce the desired cheeky relief thereof.

A further objective of this invention is to have the shaping band unseen through a wearer's outer garments.

A still further object of this invention is to provide a shaping band which is comfortable for the wearer.

A still further object of this invention is to keep the crotch zone of the pantyhose from distention or sagging.

A still further object of this invention is to keep leg portions of the pantyhose from wrinkling.

A still further object of this invention is to accommodate support hose fabrics and conventional hose fabrics as well as myriad possibilities for seams, panels and the like.

A still further object of this invention is to provide pantyhose which are easy to launder, retain their shapes and are well suited otherwise to their intended function.

DESCRIPTON OF DRAWINGS

The foregoing and other objects, features and advantages will be seen more fully from an accompanying drawing wherein.

DESCRIPTION OF PREFERRED EMBODIMENT

Figure 1:
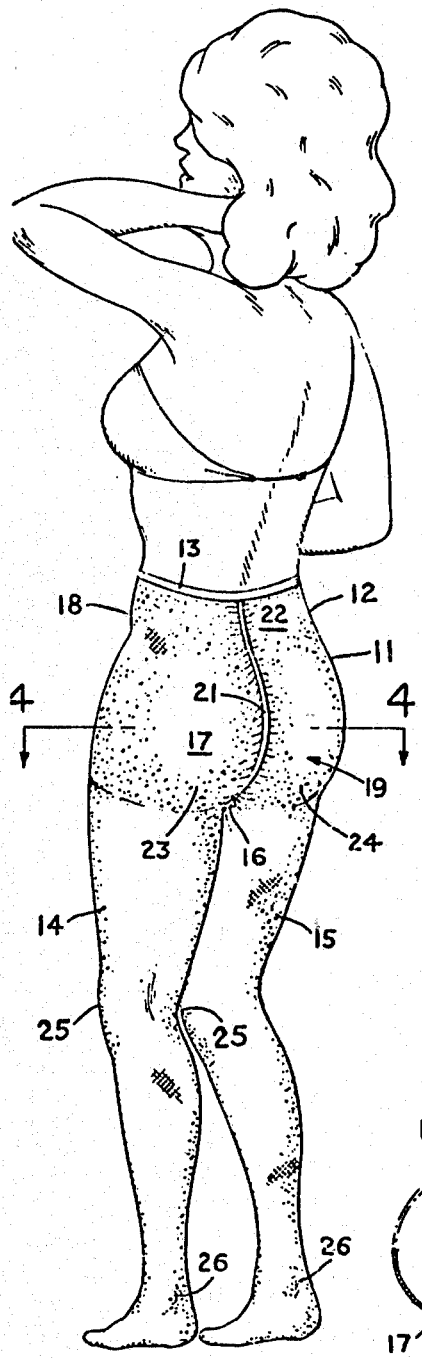
FIG. 1 shows a substantially look away view of a female wearing pantyhose according to this invention.
Figure 2:
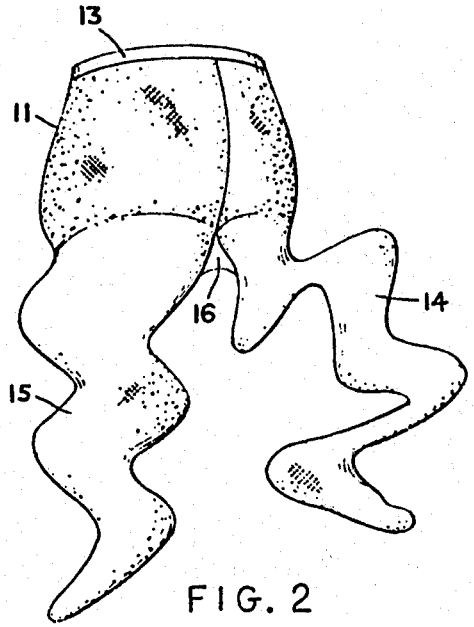
FIG. 2 is a front view of the pantyhose somewhat folded.
Figure 3:
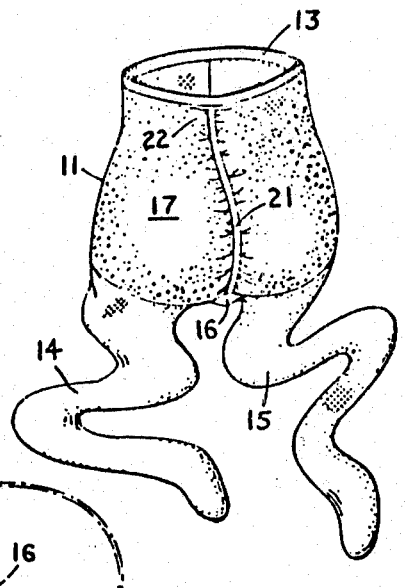
FIG. 3 is a rear view of the pantyhose somewhat folded.
Figure 4:
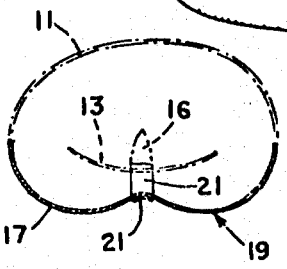
FIG. 4 is a sectional top view (taken along line 4—4 of FIG. 1) through the rear panty portion of the pantyhose on a wearer and showing attachment of the elastic shaping band.

As seen in the drawings, pantyhose according to this invention generally include a panty portion 11 encircling the wearer's lower torso 12 and having a conventional elastic waist encircling band 13, leg portions 14 and 15, and a crotch zone 16 as well as a rear panty portion 17.

Preferably the pantyhose are made with a panty portion of a jersey knit fabric having resilience and stretchability and a relatively low degree of elasticity (such as Monsanto's MONVELLE) so as to provide support for the wearer's legs 14, 15 and/or confinement for the wearer's lower abdomen 18 and derriere (generally designated 19). Unfortunately, desired flattening of the wearer's lower abdomen 18 tends to produce undesired flattening and concomitant denaturalization of the wearer's derriere 19.

It is a prime objective of this invention to produce a cheeky relief for the wearer's derriere 19. Toward this objective an elastic shaping band 21 (substantially more elastic than the fabric from which the panty portion 11 of the pantyhose is made and typically of the same material as a conventional waist band) is connected to the rear panty portion 17 and extends from the vicinity of the crotch zone 16 to the vicinity 22 of the elastic waist encircling band 13. The elastic shaping band 21 fits between the wearer's buttocks 23, 24 to accentuate their relief and to give the derriere 19 a cheeky appearance. Thusly positioned between the wearer's buttocks 23 and 24, the elastic shaping band 21 is concealed from being seen through even sheerest outer garments. The elastic shaping band 21 is comfortable for the wearer and it extends useful life of the pantyhose through innumerable washings, wearings, etc. in that the elastic shaping band 21 resists distention or sagging of the crotch 16 as well as resisting wrinkling or bagging of the leg portions 14, 15 at their knees 25 and ankles 26.

Those skilled in designing and/or making pantyhose will understand that wide deviations may be made from the foregoing description of a preferred embodiment of the invention, without departing from a main theme of invention delineated by claims which follow. By way of example, not by way of limitation, paneling and seaming of the pantyhose lend themselves to myriad combinations. Also combinations of different materials such as nonstretch leg portions 14, 15 with a stretchable panty portion 11 can be employed.

I claim:

1. Pantyhose for a female wearer and comprising:

a panty portion made of a stretchable knit fabric of a blend of nylon and elastomeric fibers, said fabric having a low degree of elasticity encircling the wearer's lower torso and having an elastic waist encircling band, the panty portion including a rear panty portion which covers and confines the wearer's buttocks, leg portions each depending from the panty portion and each arrangeable to receive one of the wearer's legs, the pantyhose defining a crotch zone between the leg portions, a shaping band attached to the rear panty portion centrally thereof and connected from the vicinity of the crotch zone to the vicinity of the waist band, the shaping band having a high degree of elasticity substantially greater than that of the fabric of the panty portion, the elasticity of the shaping band being sufficient to constrict the band into fitting engagement between the wearer's buttocks to produce cheeky relief.

2. The pantyhose of claim 1 with the stretchable fabric knit of a blend of nylon and elastomeric fibers.

3. The pantyhose of claim 2 with the stretchable fabric at least 20% elastomeric fibers.

4. The pantyhose of claim 2 with the stretchable fabric about 50% elastomeric fibers.

5. The pantyhose of claim 3 with the leg portions also made of the stretchable fabric.

6. The pantyhose of claim 4 with the leg portions also made of the stretchable fabric.

* * * * *